US009840099B2

(12) United States Patent
Honobe

(10) Patent No.: US 9,840,099 B2
(45) Date of Patent: Dec. 12, 2017

(54) LIQUID DROPLET EJECTING APPARATUS

(71) Applicant: Seiko Epson Corporation, Tokyo (JP)

(72) Inventor: Yuichi Honobe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/077,028

(22) Filed: Mar. 22, 2016

(65) Prior Publication Data

US 2016/0279986 A1 Sep. 29, 2016

(30) Foreign Application Priority Data

Mar. 26, 2015 (JP) ..... 2015-063908

(51) Int. Cl.

| | |
|---|---|
| ***B41J 25/00*** | (2006.01) |
| ***B41J 3/407*** | (2006.01) |
| ***B41J 11/00*** | (2006.01) |
| ***B41J 11/06*** | (2006.01) |

(52) U.S. Cl.

CPC ..... *B41J 25/006* (2013.01); *B41J 3/4078* (2013.01); *B41J 11/008* (2013.01); *B41J 11/0095* (2013.01); *B41J 11/06* (2013.01)

(58) Field of Classification Search

CPC ..... B41J 25/006; B41J 3/4078; B41J 11/008; B41J 11/06; B41J 11/0095

See application file for complete search history.

(56) References Cited

U.S. PATENT DOCUMENTS

| | | | | |
|---|---|---|---|---|
| 2007/0138418 | A1* | 6/2007 | Sasa | B41J 11/002 250/559.01 |
| 2007/0195119 | A1 | 8/2007 | Niimi | |
| 2012/0249656 | A1 | 10/2012 | Kawasaki et al. | |
| 2013/0050330 | A1 | 2/2013 | Hanamura | |
| 2013/0229454 | A1 | 9/2013 | Yatsunami | |
| 2013/0257973 | A1 | 10/2013 | Tamura | |
| 2014/0267487 | A1 | 9/2014 | Kitamura et al. | |

FOREIGN PATENT DOCUMENTS

| | | | |
|---|---|---|---|
| JP | 2007-223074 | A | 9/2007 |
| JP | 2009-039952 | A | 2/2009 |
| JP | 2012-166352 | A | 9/2012 |
| JP | 2012-206416 | A | 10/2012 |
| JP | 2013-075373 | A | 4/2013 |
| JP | 2013-202897 | A | 10/2013 |
| JP | 2014-051383 | A | 3/2014 |

* cited by examiner

*Primary Examiner* — Justin Seo

(74) *Attorney, Agent, or Firm* — Workman Nydegger

(57) ABSTRACT

A liquid droplet ejecting apparatus includes a medium supporting portion that moves in a transport direction in a state of supporting a medium; a liquid droplet ejecting portion that ejects liquid droplets (ink droplets) onto an ejection area of the medium supported by the medium supporting portion; a detection portion that detects a light amount of reflected light of light having been emitted toward the medium supporting portion or the medium supported by the medium supporting portion; and a carriage that reciprocates in a width direction intersecting the transport direction, in a state of supporting the liquid droplet ejecting portion and the detection portion, and a reflection pattern constituted of a high reflection portion having a high reflectance and a low reflection portion having a low reflectance which are repeatedly arranged in the width direction is formed on the medium supporting portion.

5 Claims, 8 Drawing Sheets

LIQUID DROPLET EJECTING APPARATUS

BACKGROUND

1. Technical Field

The present invention relates to a liquid ejecting apparatus, such as an ink jet printer.

2. Related Art

Heretofore, as an example of various types of liquid droplet ejecting apparatuses, ink jet printers that form characters and/or images on a medium, such as a T-shirt, by ejecting ink droplets as an example of liquid droplets onto the medium have been well known.

In printers having such a configuration, there exists a printer provided with a medium supporting portion that supports a medium; a liquid ejecting portion that ejects liquid droplets onto the medium; and an optical-type detection portion that detects whether or not the medium is supported by the medium supporting portion (for example, JP-A-2007-223074).

Further, in such a printer, a determination as to whether or not a medium is supported by the medium supporting portion is made on the basis of the difference between the light amount of reflected light that arises when light is emitted toward the medium and the light amount of reflected light that arises when light is emitted toward the medium supporting portion. For example, in the case where the reflectance of a medium is higher than that of the medium supporting portion, it is determined that the medium exists in an area which constitutes a target area of the detection by the detection portion and within which the detection portion detects reflected light having a large light amount.

By the way, in such a printer described above, it is difficult to specify an area within which a medium is supported if any difference does not occur between the light amount of the reflected light that arises when light is emitted toward the medium and the light amount of the reflected light that arises when light is emitted toward the medium supporting portion. Thus, depending on the reflectance (color) of the medium supporting portion and the reflectance (color) of a medium supported by the medium supporting portion, a situation where it is difficult to correctly specify an area within which the medium is supported by the medium supporting portion is likely to occur.

SUMMARY

An advantage of some aspects of the invention is that a liquid droplet ejecting apparatus is provided, which makes it possible to, regardless of the reflectance of a medium supported by a medium supporting portion, specify an area within which the medium is supported by the medium supporting portion, by using an optical-type detection portion.

Hereinafter, means for realizing such a liquid droplet ejecting apparatus and operational effects brought about by the means will be described.

A liquid droplet ejecting apparatus according to an aspect of the invention includes a medium supporting portion that moves in a first direction in a state of supporting a medium; a liquid droplet ejecting portion that ejects liquid droplets onto an ejection area of the medium supported by the medium supporting portion; a detection portion that detects a light amount of reflected light of light having been emitted toward the medium supporting portion or the medium supported by the medium supporting portion; and a carriage that reciprocates in a second direction intersecting the first direction, in a state of supporting the liquid droplet ejecting portion and the detection portion, and a reflection pattern constituted of a high reflection portion having a high reflectance and a low reflection portion having a low reflectance which are repeatedly arranged in the second direction is formed on the medium supporting portion.

According to the above configuration, the light amount of reflected light that arises when light is emitted toward the high reflection portion of the reflection pattern becomes larger, as compared with the light amount of reflected light that arises when light is emitted toward the low reflection portion of the reflection pattern, and thus, it becomes possible to distinctly detect the high reflection portion and the low reflection portion. Further, as a result, in a state in which a medium is supported by the medium supporting portion on which the refection pattern is formed, the medium is located between the reflection pattern and the reflection pattern in the second direction.

Further, in the case where a medium having a high reflectance is supported by the medium supporting portion, there is a possibility in that the detection portion becomes unable to distinctly detect the high reflection portion and the medium, but is able to distinctly detect the low reflection portion and the medium. Thus, in this case, when, in the second direction, there is an area within which the low reflection portion is not detected, the detection portion is able to determine that a medium (a medium having a high reflectance) is supported by the medium supporting portion within the area.

Further, in the case where a medium having a low reflectance is supported by the medium supporting portion, there is a possibility in that the detection portion becomes unable to distinctly detect the low reflection portion and the medium, but is able to distinctly detect the high reflection portion and the medium. Thus, in this case, when, in the second direction, there is an area in which the high reflection portion is not detected, the detection portion is able to determine that a medium (a medium having a low reflectance) is supported by the medium supporting portion within the area.

Accordingly, according to the above configuration, regardless of the reflectance (color) of a medium, it is possible to specify an area within which the medium is supported by the medium supporting portion, by using the detection portion of an optical type.

In the above liquid droplet ejecting apparatus, preferably, the medium supporting portion includes a mounting table on which the medium is mounted, and a frame member that presses the medium onto the mounting table by being attached to the mounting table so as to form a rim surrounding the ejection area, and the reflection pattern is formed on an area of the frame member, the area facing the detection portion.

According to the above configuration, the medium is pressed onto the mounting table by the frame member, and thus, it is possible to support the medium with more certainty, as compared with a case where the medium is mounted on the mounting table. Further, it is possible to specify the size of the frame member and the size of an inner area of the frame member (i.e., the size of the ejection area of the medium) by allowing the detection portion to detect the light amount of reflected light of light having been emitted toward the reflection pattern formed on the frame member.

In the above liquid droplet ejecting apparatus, preferably, an arrangement form of the high reflection portion and the low reflection portion in the second direction in the reflection pattern differs in accordance with at least one of the size in the first direction and the size in the second direction of the frame member.

In the case where, regardless of the size of a frame member, the same reflection pattern is formed on the frame member, in order to detect the second-direction length of a medium, it is necessary to cause the carriage to move from one edge portion toward the other edge portion in the second-direction of the frame member such that the carriage at least crosses the medium.

In contrast thereto, according to the above configuration, upon detection of the reflection pattern having an arrangement form that differs in accordance with the size of a frame member, that is, upon small movement of the carriage in the second direction, it is possible to specify the size of the frame member and the size of the inner area of the frame member (i.e., the size of the ejection area of a medium).

The above liquid droplet ejecting apparatus preferably further includes a determination portion that, when a light amount difference with respect to a light amount of the reflected light from the high reflection portion of the reflection pattern occurs depending on a detection position at which a light amount of the reflected light from the reflection pattern is detected, inhibits the ejection of the liquid droplets by the liquid droplet ejecting portion in a case where the light amount difference is large, and allows the ejection of the liquid droplets by the liquid droplet ejecting portion in a case where the light amount difference is small.

In the case where the distance from the detection portion to the reflection pattern is small, the light amount of the reflected light of the light having been emitted toward the reflection pattern is likely to become large. In contrast, in the case where the distance from the detection portion to the reflection pattern is large, the light amount of the reflected light of the light having been emitted toward the reflection pattern is likely to become small.

Further, in the case where the frame member is correctly attached to the mounting table, the distance from the detection portion to the reflection pattern is likely to become constant regardless of the positions on the frame member. In contrast, for example, in a case where the frame member is inclined relative to the mounting table, or the like, that is, in the case where the frame member is not correctly attached to the mounting table, a portion at which the distance from the detection portion to the reflection pattern is small and a portion at which the distance is large are likely to occur depending on the positions on the frame member.

Thus, in the above configuration, in the case where the light amount difference is large, it is deemed that the frame member is not correctly attached to the mounting table and the ejection of liquid droplets by the liquid ejecting portion is inhibited; while in the case where the light amount difference is small, it is deemed that the frame member is correctly attached to the mounting table and the ejection of liquid droplets by the liquid ejecting portion is allowed. According to this configuration, it is possible to suppress the ejection of liquid droplets in a state in which the medium is not pressed onto the mounting table.

The above liquid droplet ejecting apparatus preferably further includes a control portion that inhibits the ejection of the liquid droplets by the liquid droplet ejecting portion on the basis of a result of the detection of the light amount of the reflected light by the detection portion.

According to the above configuration, in a case where the size of an area on which liquid droplets are intended to be ejected is larger than the size of the ejection area of the medium, or the like, it is possible to inhibit the ejection of the liquid droplets.

In the above liquid droplet ejecting apparatus, preferably, the liquid droplet ejecting portion is supported by the carriage at a more forward position than a position of the detection portion in the first direction, and the detection portion detects the light amount of the reflected light during a period of the ejection of the liquid droplets by the liquid droplet ejecting portion.

According to the above configuration, during a movement of the carriage in the second direction, an area that is located at, in the first direction, a more forward position than the position of an area that is a target of the detection of the reflected light by the detection portion is made an ejection target area, onto which the liquid droplets are ejected by the liquid ejecting portion. Further, an area that becomes a detection target of the detection portion during a first movement of the carriage in the second direction becomes an ejection target area of the liquid droplet ejecting portion during a second movement of the carriage in the second direction after a movement of the medium supporting portion in the first direction, which is performed subsequent to the first movement of the carriage in the second direction.

Accordingly, it is possible for the liquid ejecting portion to eject liquid droplets onto an area having already become a target of the detection by the detection portion, that is, an area for which it has been specified whether or not a medium is supported.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment, in which a printing apparatus is embodied as a liquid droplet ejecting apparatus, will be described with reference to the drawings. In addition, this printing apparatus is an ink jet printer that forms characters and/or images on the surface of cloth (such as a T-shirt) as an example of a medium by ejecting ink droplets as an example of liquid droplets.

Figure 1:
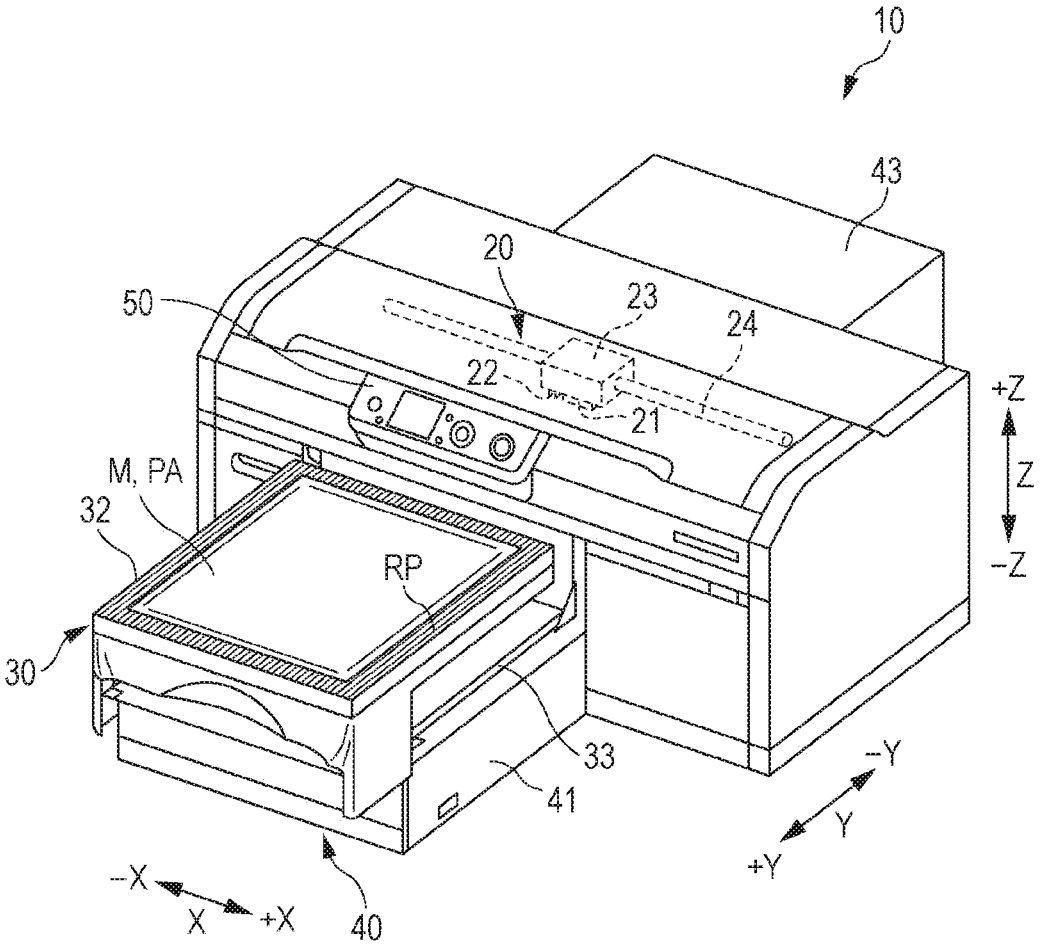
FIG. 1 is a perspective view of a printing apparatus.
Figure 2A:
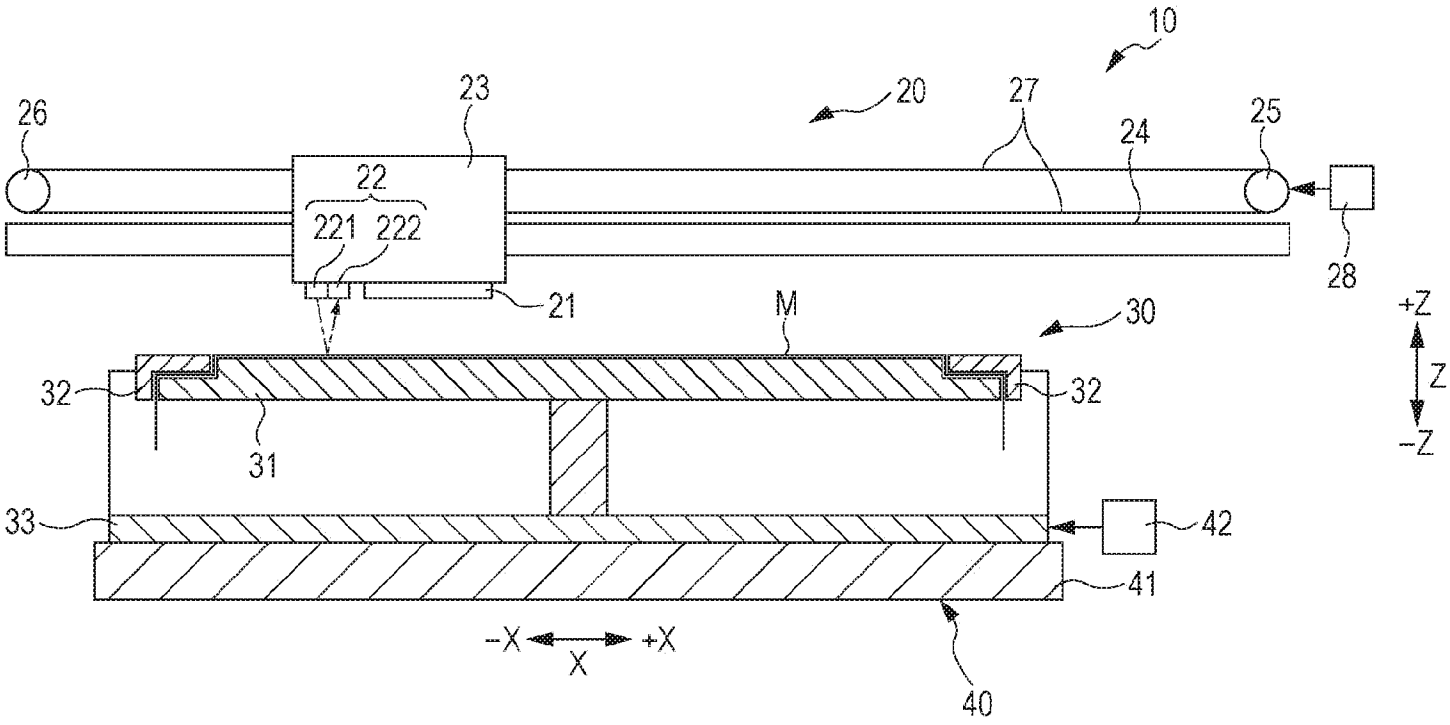
FIG. 2A is a front view illustrating a configuration of part of a printing apparatus.
Figure 2B:
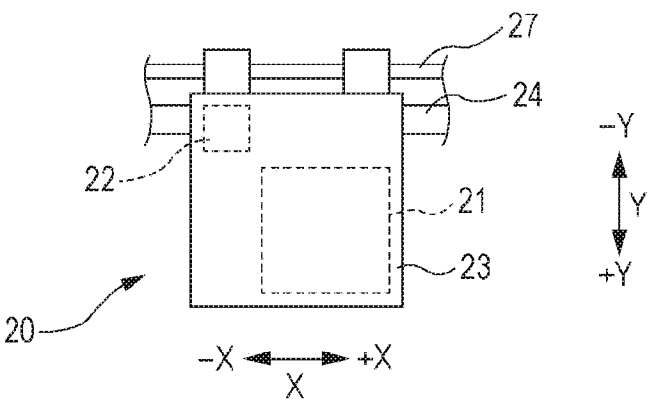
FIG. 2B is a plan view of a printing portion included in the printing apparatus.

As shown in FIG. 1 and FIGS. 2A and 2B, a printing apparatus 10 includes a printing portion 20 that executes printing on a medium such as a T-shirt; a medium supporting portion 30 that supports a medium M; a transport portion 40 that transports the medium supporting portion 30; and an operation portion 50 through which various settings for the printing apparatus 10 are performed.

In addition, in the following description, with respect to the printing apparatus 10, its width direction will be referred to as a width direction X (a width direction +X and a width direction −X); its front-back direction will be referred to as a transport direction Y (a transport direction +Y and a transport direction −Y); and its upper-lower direction will be referred to as a vertical direction Z (a vertical direction +Z and a vertical direction −Z). Here, the width direction X, the transport direction Y, and the vertical direction Z are directions perpendicular to one another.

As shown in FIG. 2A, the printing portion 20 includes a liquid droplet ejecting portion 21 that ejects liquid droplets (ink droplets); an optical-type detection portion 22 including a light emitting portion 221 and a light receiving portion 222; a carriage 23 that supports the liquid droplet ejecting portion 21 and the detection portion 22; and a guide shaft 24 that supports the carriage 23 so as to enable the carriage 23 to reciprocate in the width direction X. Further, the printing portion 20 includes a driving pulley 25 that is provided at an edge portion in the X direction; a driven pulley 26 that is provided at the other edge portion in the X direction; a timing belt 27 that is hung between the driving pulley 25 and the driven pulley 26; and a carriage motor 28 that drives the driving pulley 25.

The liquid ejecting portion 21 includes nozzles (not illustrated) formed therein, and each of the nozzles is provided with an opening so as to enable the opening to face the medium supporting portion 30. Further, as shown in FIG. 2B, the liquid ejecting portion 21 is disposed so as to be located at a more forward position than the position of the detection portion 22 in the transport direction +Y. Further, as shown in FIG. 1, the printing portion 20 performs printing on the medium M that is supported by the medium supporting portion 30 by causing the liquid ejecting portion 21 to eject liquid droplets onto a printing area PA (i.e., the ejection area) of the medium M.

As denoted by a chain line in FIG. 2A, the light emitting portion 221 of the detection portion 22 emits (projects) diffusive light toward the medium supporting portion 30 or the medium M supported by the medium supporting portion 30. Further, as denoted by another chain line in FIG. 2A, the light receiving portion 222 of the detection portion 22 receives reflected light of the diffusive light having been emitted by the light emitting portion 221, and detects the light amount (the received light amount) of the reflected light. That is, the detection portion 22 in this embodiment is a diffuse reflection type optical sensor that emits diffusive light toward a detection target, and simultaneously therewith receives reflected light from the detection target.

Further, as shown in FIGS. 2A and 2B, the driving pulley 25, the driven pulley 26, the timing belt 27, and the carriage motor 28 are provided at the rear side (at the transport-direction −Y side) of the carriage 23. The timing belt 27 is joined to a rear side portion of the carriage 23.

Through the above configuration, in conjunction with the rotation of the carriage motor 28, the timing belt 27 that is hung between the driving pulley 25 and the driven pulley 26 rotates and thereby the carriage 23 that is joined to the timing belt 27 moves in the width direction X that is a long-side direction of the guide shaft 24. Here, the carriage 23 moves in the width direction +X or in the width direction −X in accordance with the direction of the rotation of the carriage motor 28. In this respect, in this embodiment, at least one of the width direction +X and the width direction −X corresponds to an example of the "second direction".

As shown in FIG. 2A and FIGS. 3A, 3B, and 3C, the medium supporting portion 30 includes a mounting table 31 on which the medium M is mounted; a frame member 32 that is attached to the mounting table 31 so as to press the medium M onto the mounting table 31; and a supporting table 33 that supports the mounting table 31 from the lower side in the vertical direction Z.

Figure 3A:
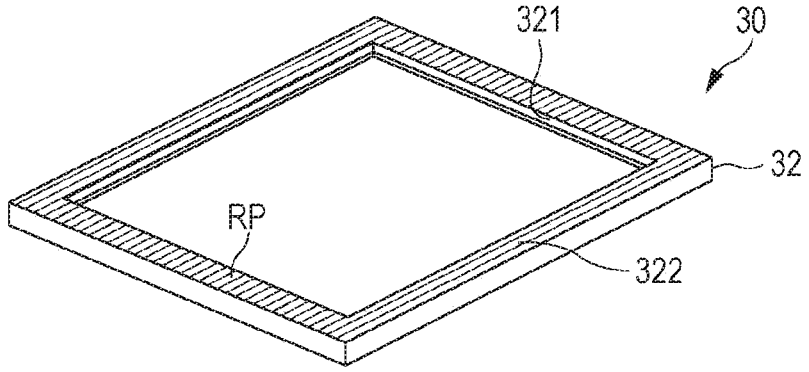
FIGS. 3A, 3B, and 3C are exploded perspective views of a medium supporting portion included in a printing apparatus.
Figure 3B:
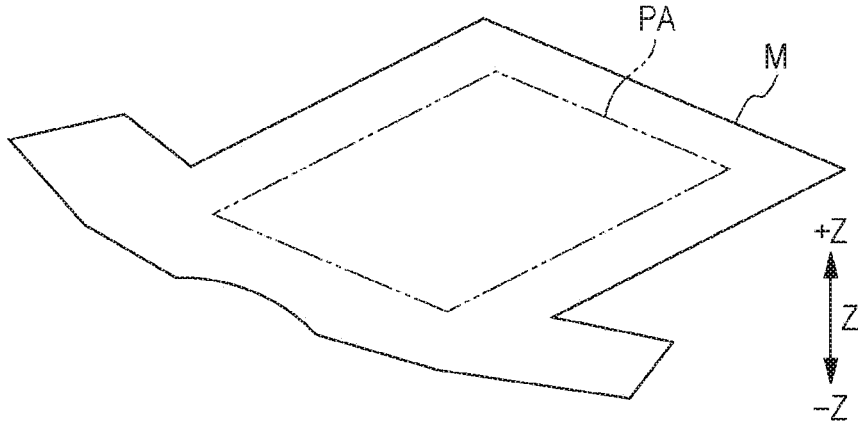
Figure 3C:
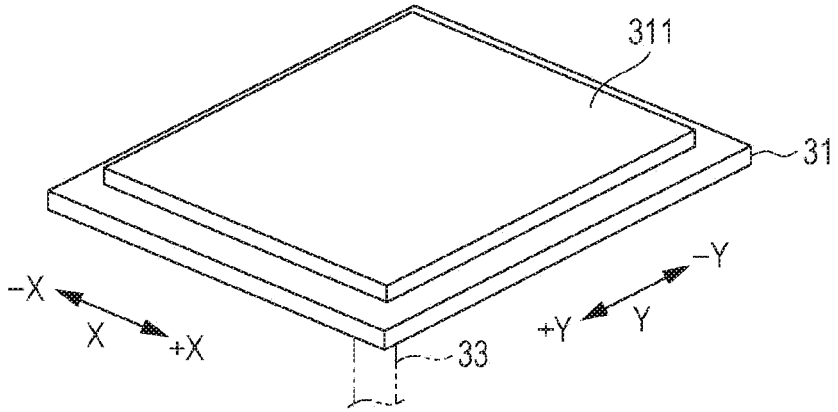

As shown in FIG. 3C, the mounting table 31 forms a substantially rectangular plate shape having a long side extending in the transport direction Y and a short side extending in the width direction X. In the mounting table 31, a convex portion 311, its outer-shape size being made slightly smaller than that of the mounting table 31 in a plan view, is formed so as to protrude in a direction opposite a direction toward the supporting table 33.

As shown in FIG. 3A, the frame member 32 forms substantially the same shape as that of the mounting table 31 in a plan view. Further, in the inside of the frame member 32, there is formed an opening portion 321, into which the convex portion 311 of the mounting table 31 is fit when the frame member 32 is attached to the mounting table 31, and through which the printing area PA of the medium M is exposed to the outside. In this way, the frame member 32 is attached to the mounting table 31 so as to form a rim surrounding the printing area PA of the medium M. In addition, in the following description, a state in which the medium M is pinched between the frame member 32 and the mounting table 31 of the medium supporting portion 30 will be expressed by a phrase the medium M is supported by the medium supporting portion 30".

Figure 4:
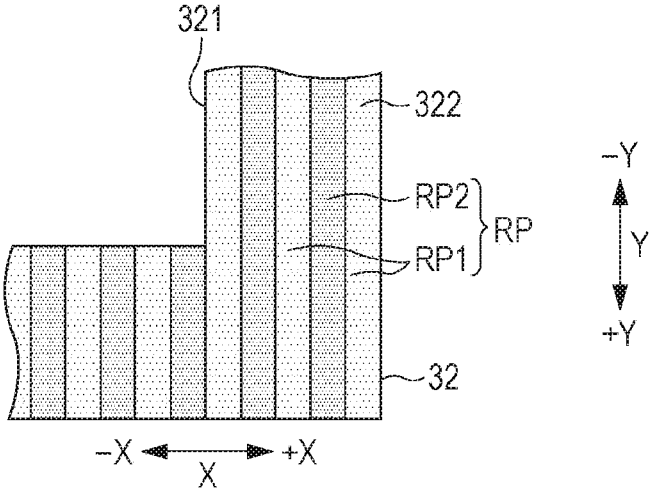
FIG. 4 is an enlarged plan view of a corner portion of a frame member of a medium supporting portion included in a printing apparatus.

As shown in FIG. 4, a reflection pattern RP, in which each of a high reflection portion RP1 having a high reflectance and a low reflection portion RP2 having a low reflectance is repeatedly arranged in the width direction X, is formed on a surface 322 of the frame member 32, the surface 322 being an area that is able to face the detection portion 22 supported by the carriage 23. As shown in FIG. 3A, the reflection pattern RP is formed across the entire area of the surface 322 of the frame member 32. In addition, FIG. 4 is an enlarged plan view of a right front corner portion of the frame member 32.

Thus, in each of the front edge portion and the rear edge portion of the frame member 32 in the transport direction Y, the reflection pattern RP is continuously formed across in the width direction X; while, in the middle portion of the frame member 32 in the transport direction Y, the reflection pattern RP is separately formed via the opening portion 321 in the width direction X. In addition, the front edge portion of the frame member 32 means a transport-direction +Y side edge portion of the frame member 32, and the rear edge portion of the frame member 32 means a transport-direction −Y side edge portion of the frame member 32.

Further, the reflection pattern RP may be directly formed on the surface of the frame member 32 (the medium supporting portion 30), or may be formed by adhering a film, on which the reflection pattern RP is formed, onto the surface of the frame member 32 (the medium supporting portion 30).

Further, the reflectance of the high reflection portion RP1 of the reflection pattern RP and the reflectance of the low reflection portion RP2 of the reflection pattern RP are sufficient provided that the reflectance of the high reflection portion RP1 is higher than the reflectance of the low reflection portion RP2 and there exists a difference in the reflectance between the high reflection portion RP1 and the low reflection portion RP2 to a degree enough to enable the detection portion 22 to distinctly detect each of the light amount of the reflected light in the high reflection portion RP1 and the light amount of the reflected light in the low reflection portion RP2. That is, the reflectance of the high reflection portion RP1 may not necessarily be larger than "0.5", and the reflectance of the low reflection portion RP2 may not necessarily be smaller than "0.5".

As examples of the high reflection portion RP1, there can be provided a white-color portion that is colored in white color, a specular reflection portion that specular-reflects light having been emitted toward itself, and the like. Further, as examples of the low reflection portion RP2, there can be provided a black-color portion that is colored in black color, a diffusion reflection portion that diffusion-reflects light having been emitted toward itself, an inclined portion including an inclined reflection face at which light having been emitted toward itself is reflected toward a position deviated from the position of the light receiving portion 222 of the detection portion 22, and the like.

Further, in this embodiment, the high reflection portion RP1 and the low reflection portion RP2 that have the same width are arranged in the width direction X so as to be alternately repeated, but are sufficient provided that the high reflection portion RP1 and the low reflection portion RP2 are repeatedly arranged so as to have regularity. For example, when the low reflection portion RP2 is represented by "0 (zero)"; while the high reflection portion RP1 is represented by "1", the reflection pattern RP in this embodiment can be represented by "101010 . . . " in the width direction X, but the reflection pattern RP may be represented by a different pattern described below. That is, the reflection pattern RP may be represented by "001001 . . . " or "001110-0111 . . . " in the width direction X.

As shown in FIG. 1 and FIG. 2A, the transport portion 40 includes a base portion 41 that supports the medium supporting portion 30 (the supporting table 33) such that the medium supporting portion 30 (the supporting table 33) is movable in the transport direction Y; a transport motor 42 that becomes a driving source when the supporting table 33 is caused to move; and a case 43 that covers the rear portion of the base portion 41.

As shown in FIG. 1, the base portion 41 is formed so as to protrude frontward from the front face of the printing apparatus 10 and protrude backward from the rear face of the printing apparatus 10. Here, when the medium supporting portion 30 is supported at the front portion of the base portion 41, the medium supporting portion 30 is exposed to the outside. Thus, in this case, it becomes possible for a user to set the medium M on the medium supporting portion 30, and remove the medium M from the medium supporting portion 30. In this regard, when, as shown in FIG. 1, the medium supporting portion 30 is supported at a position in the front portion of the base portion 41, the position will be also referred to as "a setting position" hereinafter. Meanwhile, when the medium supporting portion 30 is supported in the rear portion of the base portion 41, the medium supporting portion 30 is covered by the case 43.

In addition, as a mechanism for moving the medium supporting portion 30 (the supporting table 33), any mechanism capable of converting the rotary motion of the transport motor 42 into the linear motion of the medium supporting portion 30 (the supporting table 33) may be employed. For example, a mechanism constituted by a pulley and a belt may be employed, or a mechanism constituted by a rack and a pinion may be employed.

Further, the transport portion 40 drives the transport motor 42 so as to cause the medium supporting portion 30 (the supporting table 33) to move in the transport direction Y. In addition, the direction in which the medium supporting portion 30 is transported differs in accordance with the direction in which the transport motor 42 rotates.

Further, since the printing apparatus 10 according to this embodiment is a so-called serial printer, when performing printing onto the medium M, the printing apparatus 10 alternately executes two kinds of operations: one being a transport operation for transporting the medium supporting portion 30 (the medium M) in the transport direction +Y; the other one being a movement operation for moving the carriage 23 in the width direction +X or in the width direction −X. In the following description, a transport amount in the transport operation by the medium supporting portion 30, which is executed alternately with the movement operation for moving the carriage 23, will be also referred to as "a unit transport amount".

Further, the printing apparatus 10 according to this embodiment is configured to, upon start of printing after a setting of the medium M on the medium supporting portion 30 at the setting position, first, cause the medium supporting portion 30 to move in the transport direction −Y such that the medium supporting portion 30 is supported in the rear portion of the base portion 41. Subsequently, the printing portion 20 executes printing onto the medium M supported by the medium supporting portion 30 in conjunction with the movement of the medium supporting portion 30 in the transport direction +Y. In this respect, in this embodiment, the transport direction +Y corresponds to an example of the "first direction".

Figure 5:
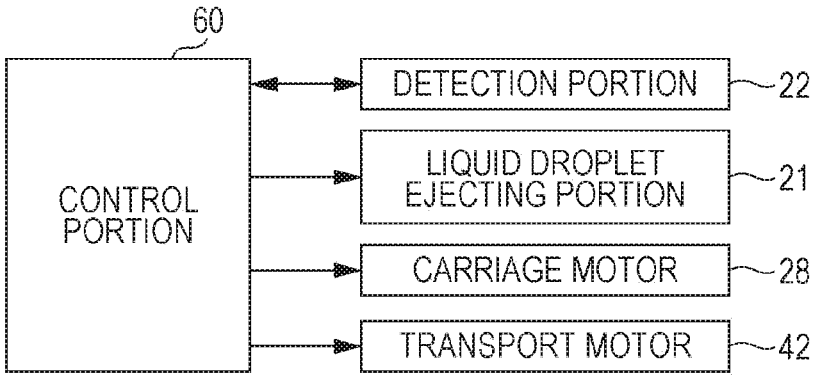
FIG. 5 is a block diagram illustrating an electrical configuration of a printing apparatus.

Next, an electrical configuration of the printing apparatus 10 will be described with reference to FIG. 5. As shown in FIG. 5, the printing apparatus 10 includes a control portion 60 that controls the apparatus in an integrated manner. The input interface side of the control portion 60 is electrically connected to the detection portion 22; while the output interface side of the control portion 60 is electrically connected to the detection portion 22, the liquid droplet ejecting portion 21, the carriage motor 28, and the transport motor 42. Through this configuration, the control portion 60 controls the operation of the liquid ejecting portion 21 and the driving of each of the carriage motor 2 and the transport motor 42 on the basis of detection signals from the detection portion 22, that is, the light amounts of the reflected light rays.

In addition, hereinafter, the operation of causing the liquid droplet ejecting portion 21 to repeatedly eject liquid droplets toward the medium M, in conjunction with the operation of repeatedly driving the carriage motor 28 so as to cause the carriage 23 to move in the width direction +X or in the width direction −X, will be also referred to as "a printing operation (an ejection operation)". Moreover, hereinafter, the operation of repeatedly emitting light toward the medium M or the reflection pattern RP formed on the frame member 32 to repeatedly detect the light amount of reflected light of the emitted light, in conjunction with the operation of repeatedly causing the carriage 23 to move in the width direction +X or in the width direction −X, will be also referred to as "a detection operation".

Next, a processing routine that is executed by the control portion 60 of the printing apparatus 10 when printing is performed by the printing apparatus 10 will be described with reference to a flowchart shown in FIG. 6. This processing routine is a processing routine that is executed every time a user issues a printing command to the printing apparatus 10 after having set the medium M on the medium supporting portion 30.

Figure 6:
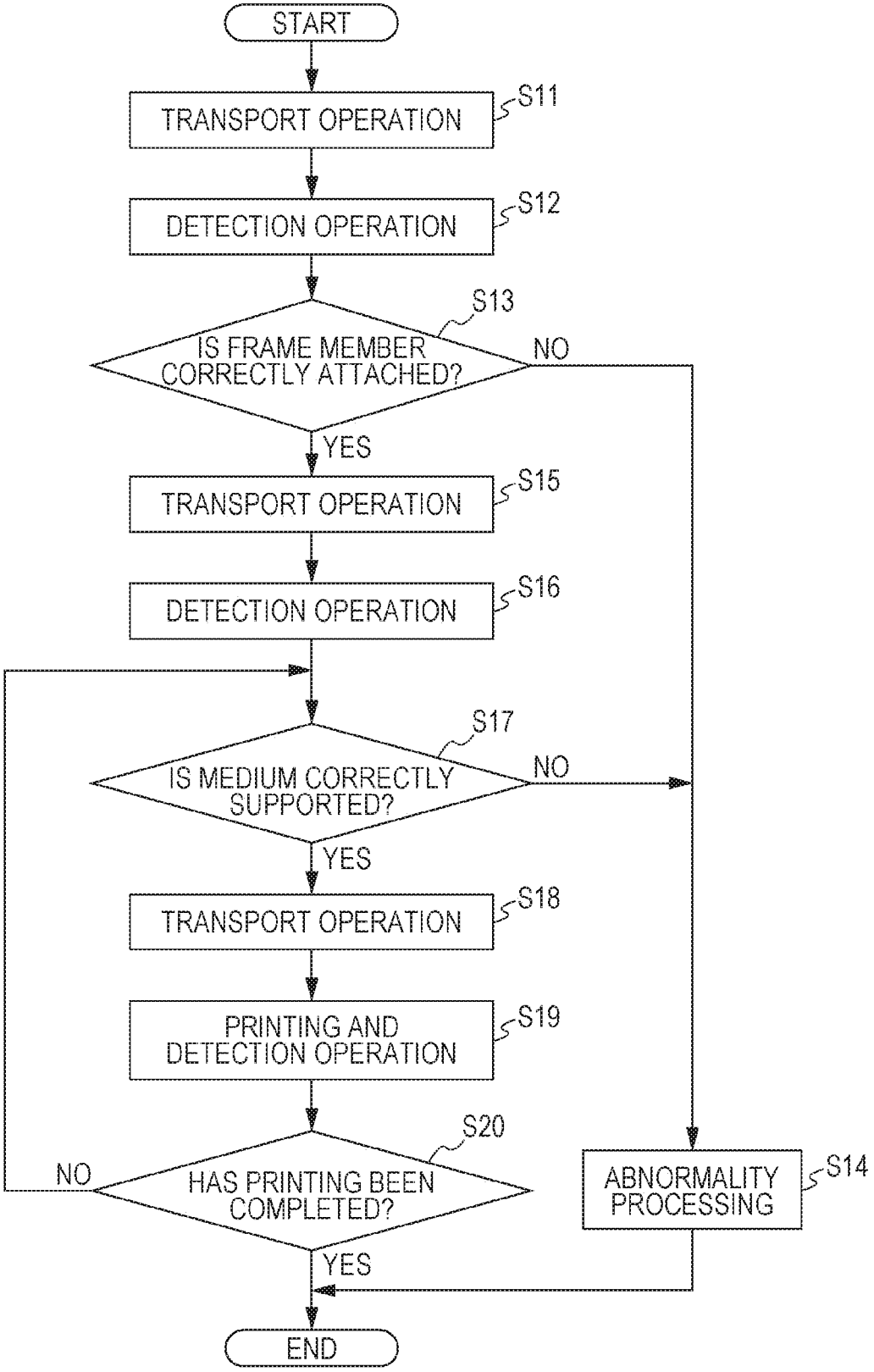
FIG. 6 is a flowchart illustrating a processing routine executed by a control portion when printing is performed.

As shown in FIG. 6, upon receipt of a printing command, the control portion 60 executes a transport operation for transporting the medium supporting portion 30 by driving the transport motor 42 (step S11). Speaking in detail, the control portion 60 causes the medium supporting portion 30 to be transported in the transport direction −Y from the setting position such that the front edge portion of the frame member 32 of the medium supporting portion 30 overlaps the detection portion 22 supported by the carriage 23 in the transport direction Y in a plan view.

Subsequently, the control portion 60 drives the carriage motor 28 and the detection portion 22 such that the detection operation is executed (step S12). In this way, the control portion 60 acquires a light-amount distribution in the width direction X when only the frame member 32 is made a detection target. Further, the control portion 60 determines whether or not the frame member 32 is correctly attached to the mounting table 31 on the basis of the result of the detection operation by the detection portion 22 (step S13).

Here, the light amount of the reflected light detected by the detection portion 22 increases as the distance from the detection portion 22 to the reflection pattern RP decreases. Accordingly, in the case where the light amount of the reflected light from the high reflection portion RP1 of the reflection pattern RP varies in the width direction X, or gradually increases or decreases as the detection portion 22 moves forward in the width direction +X or in the width direction −Y, it can be said that the distance from the detection portion 22 to the reflection pattern RP varies in the width direction X. That is, in this case, it can be determined that the frame member 32 is, for example, in a state of being gradually floated from the mounting table 31 in the width direction +X and, as a result, the frame member 32 is not correctly attached to the mounting table 31.

Here, hereinafter, in the light-amount distribution in the width direction X, the absolute value of a difference between a minimum one of the light amounts of the reflected light rays from the high reflection portions RP1 and a maximum one of the light amounts of the reflected light rays from the high reflection portions RP1 will be referred to as "a light amount difference ΔLV". In this case, it is possible to determine that the frame member 32 is not correctly attached to the mounting table 31 in the case where the light amount difference ΔLV is large, and it is possible to determine that the frame member 32 is correctly attached to the mounting table 31 in the case where the light amount difference ΔLV is small.

Specifically, "a determination value LVth", which is a threshold value, is obtained in advance through experiments or the like, and in the case where the light amount difference ΔLV is larger than or equal to the determination value LVth, it may be determined that the frame member 32 is not correctly attached to the mounting table 31; while in the case where the light amount difference ΔLV is smaller than the determination value LVth, it may be determined that the frame member 32 is correctly attached to the mounting table 31. Further, the determination value LVth may be a fixed value, or may be a variable value that is determined in accordance with the type of the medium M or a setting by a user.

In the case where the frame member 32 is not correctly attached to the mounting table 31 (NO in step S13), the control portion 60 executes abnormality processing (step S14), and thereafter terminates the process flow once. Here, the abnormality processing is, for example, processing for ceasing the execution of printing, and processing for notifying a user of a situation in which it is difficult to execute the printing, and continue execution of printing. In this regard, it can be said that, in this embodiment, the execution of the printing operation is inhibited in the case where the light amount difference ΔLV is large (i.e., the light amount difference ΔLV≥the determination value LVth).

Meanwhile, in the case where the frame member 32 is correctly attached to the mounting table 31 (YES in step S13), the control portion 60 execute the transport operation for transporting the medium supporting portion 30 by driving the transport motor 42 (step S15). Speaking in detail, the control portion 60 causes the medium supporting portion 30 to be transported in the transport direction +Y such that the printing area PA of the medium M supported by the medium supporting portion 30 overlaps the detection portion 22 in the transport direction Y in a plan view.

Further, the control portion 60 controls the driving of each of the carriage motor 28 and the detection portion 22 such that the detection operation is executed once again (step S16). This detection operation in step S16 is different from the detection operation in step S12, and in step S16, the frame member 32 and the medium M that is in a state of being fixed to the mounting table 31 by the frame member 32 become detection targets. Thus, as a result, the light-amount distribution extending in the width direction X and being obtained through the detection operation in step S16 becomes different from the light-amount distribution extending in the width direction X and being obtained through the detection operation in step S12.

Subsequently, the control portion 60 determines whether or not the medium M is correctly supported by the medium supporting portion 30, on the basis of the result of the detection operation by the detection portion 22 (step S17). Here, the above phrase "the medium M is correctly supported" means that the size of the printing area PA of the medium M is larger than the size of an area of the medium M, within which the printing apparatus 10 intends to print characters and/or images, thus enabling the characters and/or the images to be printed within the printing area A of the medium M.

In addition, the reason why it is possible to determine that the medium M is correctly supported within an area inside the inner edge portion of the frame member 32 on the basis of the result of the detection operation by the detection portion 22 (i.e., on the basis of the obtained light-amount distribution in the width direction X) is because the light-amount distribution of the reflected light rays from the medium M in the width direction X and the light-amount distribution of the reflected light rays from the reflection pattern RP in the width direction X are different from each other. That is, this is because the light-amount distribution of the reflected light rays in the case where the detection target is the medium M is substantially constant; while the light-amount distribution of the reflected light rays in the case where the detection target is the reflection pattern RP varies with regularity so as to correspond to the individual high reflection portions RP1 and the individual low reflection portions RP2.

Further, in the case where the medium M is not correctly supported by the medium supporting portion 30 (NO in step S17), the control portion 60 causes the process flow to proceed to step S14. In contrast, in the case where the medium M is correctly supported by the medium supporting portion 30 (YES in step S17), the control portion 60 executes the transport operation for transporting the medium supporting portion 30 by driving the transport motor 42 (step S18). Speaking in detail, the control portion 60 causes the medium supporting portion 30 to be transported in the transport direction +Y by the unit transport amount. As a result of this operation, the printing area PA of the medium M, which has been in a state of overlapping the detection portion 22 in the transport direction Y in a plan view before the execution of the transport operation, overlaps the liquid droplet ejecting portion 21 in the transport direction Y in a plan view after the execution of the transport operation.

Further, the control portion 60 controls the driving of each of the carriage motor 28 and the detection portion 22 such that the printing operation is executed, and simultaneously therewith, the detection operation is executed once again (step S19). That is, in the printing operation, the control portion 60 causes liquid droplets to be ejected toward the medium M from the liquid droplet ejecting portion 21 supported by the carriage 23 that is moving in the width direction X. Further, in the detection operation that is executed simultaneously with the printing operation, the frame member 32 and the medium M, which is fixed to the mounting table 31 by the frame member 32, become detection targets, just like in the detection operation in step S16.

Subsequently, the control portion 60 determines whether or not the printing onto the medium M has been completed (step S20). In the case where the printing is not yet completed (NO in step S20), the control portion 60 causes the process flow to proceed to step S17. That is, in the case where the printing operation is not yet completed, the processes in steps S17 to S20 are repeatedly executed only if the medium M is correctly supported.

In contrast, in the case where the printing has been already completed (YES in step S20), the control portion 60 terminates the process flow once.

In this way, in this embodiment, as shown in steps S12 and S13 and steps S16 and S17, the ejection of the liquid droplets from the liquid droplet ejecting portion 21 is inhibited by the control portion 60 on the basis of the result of the detection operation by the detection portion 22 for detecting the light amounts of the reflected light rays. Further, in this embodiment, the control portion 60, which is configured to, as having been described in steps S13 and S14, when the light amount difference ΔLV occurs depending on the detection positions on the frame member 32, inhibit the execution of the printing operation in the case where the light amount difference ΔLV is large, and in contrast, allow the execution of the printing operation in the case where the light amount difference ΔLV is small, corresponds to an example the "determination portion".

Next, the operation of the printing apparatus 10 according to this embodiment will be described with reference to FIGS. 7A and 7B and FIGS. 8A and 8B. In addition, in FIG. 7A and FIG. 8A, a solid line with an arrow, which is drawn so as to overlap the detection portion 22, indicates an area that is made a detection target of the detection portion 22, and an outline arrow indicates a direction in which the carriage 23 moves. Further, in FIG. 7B and FIG. 8B, for the ease of understanding the following description, the light-amount distribution of the reflected light rays is illustrated as a rectangular wave shaped signal.

In the printing apparatus 10 according to this embodiment, when printing onto the medium M is performed, the medium supporting portion 30 is caused to move to the setting position to allow a user to set the medium M.

Figure 7A:
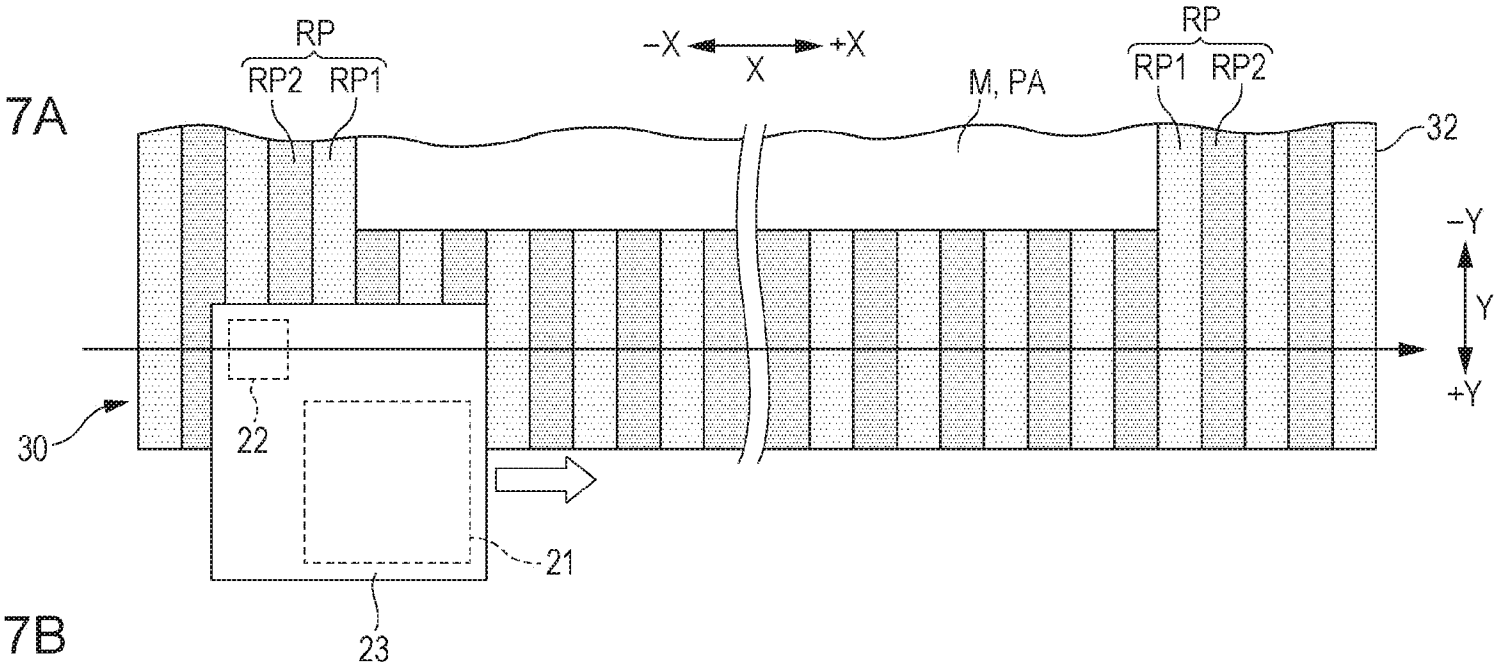
FIG. 7A is a plan view of a medium supporting portion that supports a medium.

Further, upon receipt a printing command from the user, as shown in FIG. 7A, the medium supporting portion 30 is transported in the transport direction −Y such that the front edge portion of the frame member 32 of the medium supporting portion 30 and the detection portion 22 supported by the carriage 23 overlap each other in the transport direction Y in a plan view. Subsequently, in conjunction with the movement of the carriage 23 in the width direction X, the detection operation is performed such that the detection portion 22 moves across the frame member 32, on which the reflection pattern RP is formed, in the width direction X, and thereby, the light-amount distribution of the reflected light rays in the width direction X is obtained, as shown in FIG. 7B.

Figure 7B:
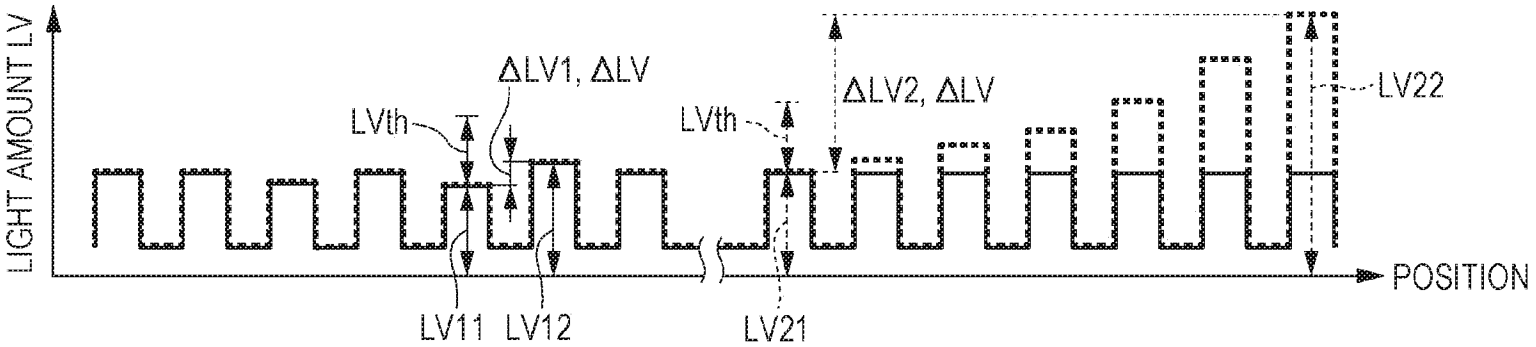
FIG. 7B is a graph illustrating a light-amount distribution of reflected light rays in a width direction when a frame member is a detection target.

Here, it is assumed that a light-amount distribution denoted by a solid line in FIG. 7B has been obtained. In the light-amount distribution in this case, a pair of a portion in which a light amount corresponding to the high reflection portion RP1 of the reflection pattern RP is large and a portion in which a light amount corresponding to the low reflection portion RP2 of the reflection pattern RP is repeated, and simultaneously therewith, the light amount corresponding to the high reflection portion RP1 that is repeated in the width direction X is substantially constant.

Thus, in the width direction X, the light amount difference ΔLV that is a difference between a minimum light amount LV11 and a maximum light amount LV12 in the high reflection portions RP1 becomes a light amount difference ΔLV1 that is smaller than the determination value LVth. Accordingly, the distance between the detection portion 22 and the reflection pattern RP does not vary in the width direction X, thus making it possible to determine that the frame member 32 is correctly attached to the mounting table 31.

Meanwhile, it is assumed that a light-amount distribution denoted by a dashed line in FIG. 7B has been obtained. In the light-amount distribution in this case, just like the case in which the light-amount distribution is denoted by the solid line, a pair of a portion in which a light amount corresponding to the high reflection portion RP1 of the reflection pattern RP is large and a portion in which a light amount corresponding to the low reflection portion RP2 of the reflection pattern RP is small is repeated. In this case, however, the light-amount distribution is different from that denoted by the solid line. That is, a light amount corresponding to the high reflection portion RP1 that is repeated at one side in the width direction X (i.e., at a width-direction −X side) is substantially constant; while in contrast, a light amount corresponding to the high reflection portion RP1 that is repeated at the other side in the width direction X (i.e., at a width-direction +X side) gradually increases as the detection position of the light amount moves forward in the width direction +X.

That is, differences among the light amounts corresponding to the high reflection portions RP1 occur depending on the detection positions in the width direction X. Further, the light amount difference ΔLV, which is the difference between the minimum light amount LV21 and the maximum light amount LV22 in the high reflection portions RP1, becomes a light amount difference ΔLV2 that is larger than or equal to the determination value LVth.

Accordingly, it is determined that the frame member 32 is correctly attached to the mounting table 31 at the one side of the width direction X (i.e., at the width-direction −X side), but it is determined that the frame member 32 is not correctly attached to the mounting table 31 at the other side of the width direction X (i.e., at the width-direction +X side).

In this way, it is possible to determine whether or not the frame member 32 is correctly attached to the mounting table 31 before the liquid droplets are ejected toward the medium M, and thus, in the case where the frame member 32 is not correctly attached to the mounting table 31, the execution of printing is prevented.

Incidentally, in the light-amount distribution shown in FIG. 7B, for the ease of understanding the description, it has been assumed that the light amount corresponding to the low reflection portion RP2 does not vary in accordance with the distance between the detection portion 22 and the frame member 32 (the reflection pattern RP). That is, it has been assumed that the reflectance of the low reflection portion RP2 is "0 (zero)".

Figure 8A:
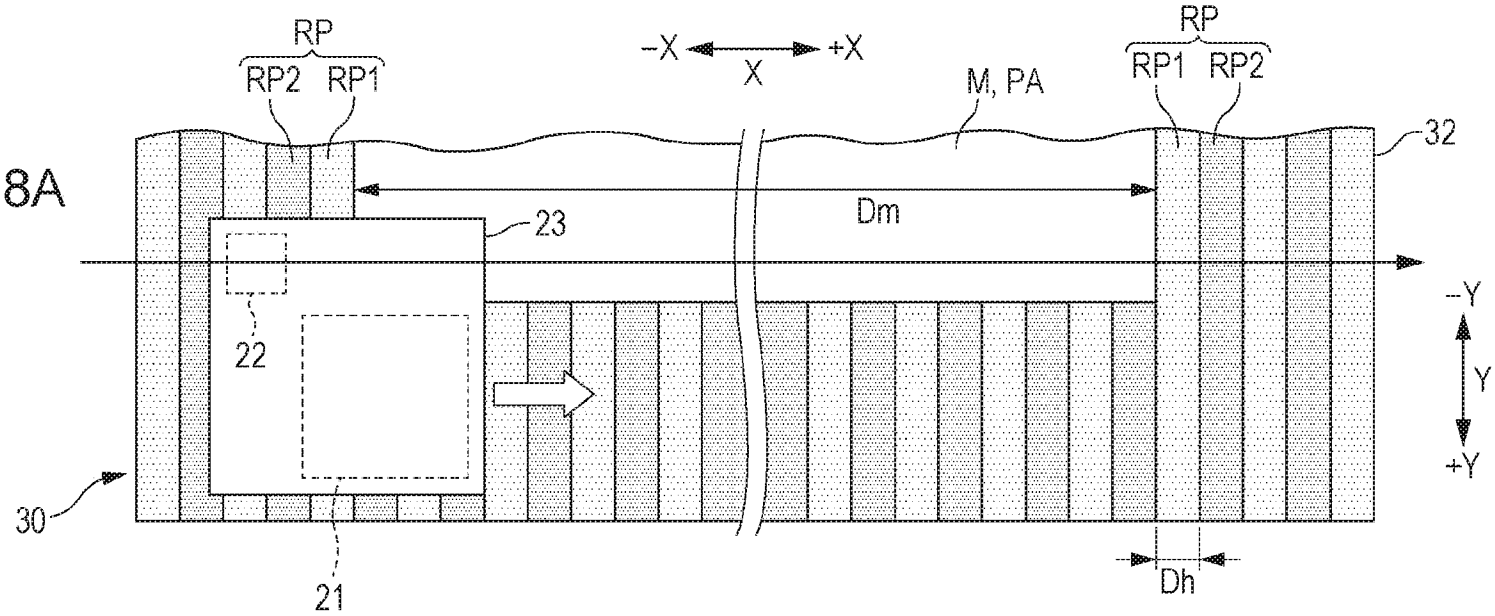
FIG. 8A is a plan view of a medium supporting portion that supports a medium.

By the way, in the case where it has been determined that the frame member 32 is correctly attached, the medium supporting portion 30 is transported in the transport direction +Y, as shown in FIG. 8A, such that the printing area PA of the medium M supported by the medium supporting portion 30 overlaps the detection portion 22 in the transport direction Y in a plan view. Subsequently, in conjunction with the movement of the carriage 23 in the width direction X, the detection operation by the detection portion 22 is executed such that the detection portion 22 moves so as to cross the medium M, and the frame member 32 on which the reflection pattern RP is formed, and as a result, as shown in FIG. 8B, a light-amount distribution of the reflected light rays in the width direction X is obtained.

Figure 8B:
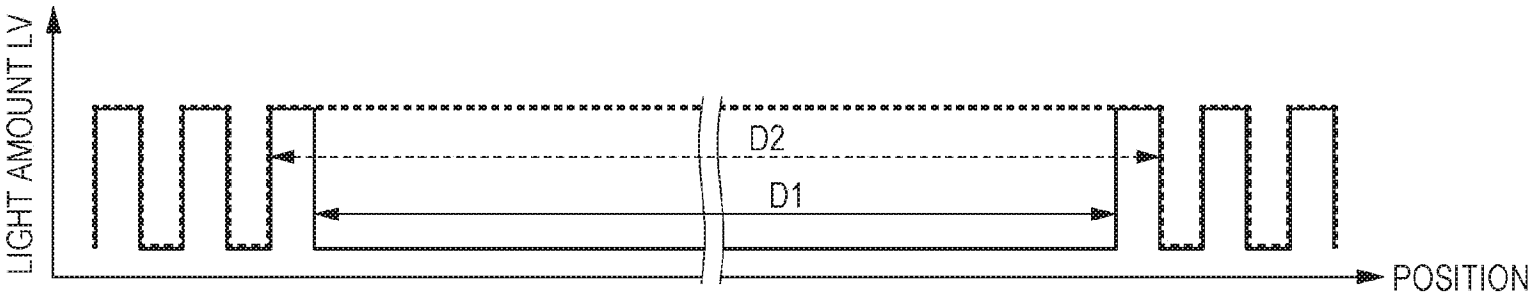
FIG. 8B is a graph illustrating a light-amount distribution of reflected light rays in a width direction when a frame member and a medium are detection targets.

Here, in FIG. 8B, a light-amount distribution in the case where the reflectance of the medium M (the printing area PA) is low is denoted by a solid line, and a light-amount distribution in the case where the reflectance of the medium M (the printing area PA) is high is denoted by a dashed line. Further, for the ease of understanding the following description, it is assumed that the reflectance of the medium M in the case where the reflectance is low is equal to the reflectance of the low reflection portion RP2 of the reflection pattern RP, and the reflectance of the medium M in the case where the reflectance is high is equal to the reflectance of the high reflection portion RP1 of the reflection pattern RP.

In the light-amount distribution being denoted by the solid line in FIG. 8B and corresponding to the case where the reflectance of the medium M is low, a pair of a portion in which a light amount corresponding to the high reflection portion RP1 of the reflection pattern RP is large and a portion in which a light amount corresponding to the low reflection portion RP2 of the reflection pattern RP is small is repeated at each of one side and the other side in the width direction X; while, in a middle portion in the width direction X, the light amount becomes low in accordance with the medium M having a low reflectance.

In this case, it is possible to determine that the medium supporting portion 30 supports the medium M within an area between both the most inner side ones of detection positions at each of which, actually, the light amount corresponding to the high reflection portion RP1 has been able to be detected. Further, the length of the medium M in the width direction X (i.e., the length of the opening portion 321 of the frame member 32) is determined as a distance D1 between both the most inner side ones of the detection positions at each of which, actually, the light amount corresponding to the high reflection portion RP1 has been able to be detected. In this way, even when printing of images and/or the like having a length longer than the distance D1 in the width direction X is intended, the printing is inhibited.

Further, in the light-amount distribution being denoted by the dashed line in FIG. 8B and corresponding to the case where the reflectance of the medium M is high, a pair of a portion in which a light amount corresponding to the high reflection portion RP1 of the reflection pattern RP is large and a portion in which a light amount corresponding to the low reflection portion RP2 of the reflection pattern RP is small is repeated at each of one side and the other side in the width direction X; while, in a middle portion in the width direction X, the light amount becomes high in accordance with the medium M having a high reflectance.

In this case, it is possible to determine that the medium supporting portion 30 supports the medium M within an area between both the most inner side ones of detection positions at each of which, actually, the light amount corresponding to the low reflection portion RP2 has been able to be detected. Further, the length of the medium M in the width direction X (i.e., the length of the opening portion 321 of the frame member 32) is determined as a distance D2 between both the most inner side ones of the detection positions at each of which, actually, the light amount corresponding to the low reflection portion RP2 has been able to be detected. In this way, even when printing of images or the like having a length larger than the distance D2 in the width direction X is intended, the printing is inhibited.

In addition, in the case where the medium M having a high reflectance is supported by the medium supporting portion 30, portions each having a high reflectance are arranged at the boundary between the frame member 32 and the medium M in the width direction X, and thus, the distance D2 based on the detection positions at each of which the low reflection portion RP2 is detected becomes longer than a length Dm that is the actual length of the medium M in the width direction X (i.e., D2>Dm). Thus, in this case, when the length of the high reflection portion RP1 in the width direction X is denoted by Dh, the distance D2 based on the detection positions at each of which the low reflection portion RP2 is detected may be corrected by subtracting twice the length Dh of the high reflection portion RP1 from the distance D2.

Further, even in the case where the reflectance of the medium M is different from each of the reflectance of the high reflection portion RP1 of the reflection pattern RP and the reflectance of the low reflection portion RP2 of the reflection pattern RP, the length of the medium M in the width direction X can be obtained on the basis of any one of two sets of detection positions: one of the two sets being a set of detection positions at each of which, actually, the light amount corresponding to the high reflection portion RP1 has been able to be detected; the other one of the two sets being a set of detection positions at each of which, actually, the light amount corresponding to the low reflection portion RP2 has been able to be detected.

Further, in the case where the length of the medium M in the width direction X, having been obtained on the basis of the result of the detection operation by the detection portion 22, is a length appropriate for continuing printing, the medium supporting portion 30 is transported in the transport direction +Y by the unit transport amount. In this way, an area having being in a state of overlapping the detection portion 22 in the transport direction Y in a plan view before the transport operation results in a state of overlapping the liquid droplet ejecting portion 21 in the transport direction Y in a plan view after the transport operation, and the detection operation and the printing operation are executed simultaneously with each other on a portion constituting the printing area PA and being located at a further forward position in the transport direction −Y.

That is, in this embodiment, the printing operation is executed on a first area having been a target of the detection operation before the transport of the medium transporting portion 30, and simultaneously with the printing operation, the detection operation is executed on a second area located at a more forward position than the position of the first area in the transport direction −Y. Through this operation, when the light-amount distribution of the reflected light rays in the width direction X obviously changes in a case where the rear edge portion of the frame member 32 overlaps the detection portion 22 in the transport direction Y in a plan view, or the like, after the completion of a subsequent transport operation for transporting the medium supporting portion 30, the execution of the printing operation is inhibited. That is, it is prevented that the liquid droplets are ejected onto an area on which the medium M is not supported.

According to the aforementioned embodiment, the following advantageous effects are brought about.

(1) The reflection pattern RP in which a pair of the high reflection portion RP1 and the low reflection portion RP2 is repeatedly arranged is provided on the medium supporting portion 30 (the frame member 32). Through this configuration, in the case where the medium M having a high reflectance is supported by the medium supporting portion 30, it is possible to determine whether or not the medium M is supported, on the basis of positions at each of which the low reflection portion RP2 has been detected; while, in the case where the medium M having a low reflectance is supported by the medium supporting portion 30, it is possible to determine whether or not the medium M is supported, on the basis of positions at each of which the high reflection portion RP1 has been detected. In this way, according to this embodiment, differing from a case where the reflection pattern RP is formed of only the high reflection portions RP1 and a case where the reflection pattern RP is formed of only the low reflection portions RP2, it is possible to, regardless of the reflectance (color) of the medium M, specify an area which exists on the medium supporting portion 30 and within which the medium M is supported.

(2) It is possible to press the medium M onto the mounting table 31 by using the frame member 32, thus making it possible to support the medium with more certainty, as compared with a case where the medium M is mounted on the medium mounting table 31. Further, the light amount of the reflected light of light having been emitted toward the reflection pattern RP formed on the frame member 32 is detected by the detection portion 22, thereby making it possible to determine the size of the printing area PA of the medium M, onto which the liquid droplets are ejected (the size of the frame member 32). For this reason, for example, in a case where the size of an area onto which the liquid droplets are intended to be ejected is larger than the size of the printing area A of the medium M, or the like, it possible to inhibit the ejection of the liquid droplets, and notify a user of the printing apparatus 10 of such a situation.

(3) In the case where the light amount difference ΔLV of the reflected light rays is large, it is deemed that the frame member 32 is not correctly attached to the mounting table 31, thereby making it possible to inhibit the ejection of the liquid droplets by the liquid ejecting portion 21. In contrast, in the case where the light amount difference ΔLV of the reflected light rays is small, it is deemed that the frame member 32 is correctly attached to the mounting table 31, thereby making it possible to allow the ejection of the liquid droplets by the liquid ejecting portion 21. Accordingly, it is possible to suppress the ejection of liquid droplets in a state in which the frame member 32 is not correctly attached to the mounting table 31 and the medium M is not sufficiently pressed onto the mounting table 31.

(4) When each of the determination that the frame member 32 is not correctly attached (NO in step S13) and the determination that the medium M is not correctly supported (NO in step S20) is made on the basis of the results of the detections of the reflected light rays by the detection portion 22, the execution of the printing operation is inhibited, thus making it possible to prevent the execution of printing onto the medium M that is in a state of being likely to cause a printing failure.

(5) In the carriage 23, the liquid ejecting portion 21 is supported at a more forward position than the position of the detection portion 22 in the transport direction +Y. Thus, an area that becomes a detection target of the detection portion 22 during a first movement of the carriage 23 in the width direction X becomes an ejection target area of the liquid droplet ejecting portion 21 during a second movement of the carriage 23 in the width direction X after the medium supporting portion 30 has moved in the transport direction +Y subsequent to the first movement of the carriage 23 in the width direction X. Accordingly, it is possible to allow the liquid droplet ejecting portion 21 to eject liquid droplets onto an area for which the presence or absence of the medium M has already been specified by the detection portion 22.

In addition, the aforementioned embodiment may be changed as follows.

In the medium supporting portion 30, the frame member 32 may not be provided. In this case, it is preferable that the reflection pattern RP is formed across the entire surface of the mounting table 31. Through this configuration, it is possible to detect the length of the medium M in the width direction X in a state in which the medium M is mounted on the mounting table 31, on the basis of the differences between the results of detections of the reflection pattern RP that is covered by the medium M and the results of detections of the reflection pattern RP that is not covered by the medium M.

That is, in the case where the reflectance of the medium M is low, the length of the medium M in the width direction X becomes substantially equal to the distance between both the most inner ones of detection positions at each of which, actually, the light amount corresponding to the high reflection portion RP1 has been able to be detected. Further, in the case where the reflectance of the medium M is high, the length of the medium M in the width direction X becomes substantially equal to the distance between both the most inner ones of detection positions at each of which, actually, the light amount corresponding to the low reflection portion RP2 has been able to be detected. In this way, regardless of the reflectance of the medium M, it is possible to detect the length of the medium M in the width direction X, and further determine whether or not the medium M is mounted on the medium supporting portion 30.

It is preferable that the mounting table 31 and the frame member 32 are replaceable in accordance with the size of the medium M or the size of an image that is intended to be printed on the medium M. In addition, in this case, it is preferable that the mounting table 31 is freely attachable/detachable to/from the supporting table 33.

In the case where the frame member 32 having a different size (this size being at least one of the size in the transport direction Y and the size in the width direction X) is used, the arrangement form of the high reflection portions RP1 and the low reflection portions RP2 in the reflection pattern RP that is formed on the frame member 32 may be changed in accordance with the size of the frame member 32. For example, in the case where a frame member of a small size, a frame member of a middle size, and a frame member of a large size are provided as the frame members 32, the reflection pattern RP formed on the frame member of a small size may be a pattern "001001001 . . . "; the reflection pattern RP formed on the frame member of a middle size may be a pattern "011011011 . . . "; and the reflection pattern RP formed on the frame member of a large size may be a pattern "110110110 . . . ".

According to this configuration, it is possible to specify the size of the frame member 32 by determining that the minimum unit of the repetition rule for the reflection pattern is "001", "011", or "110". That is, it is possible to specify the size of the frame member 32 merely by causing the carriage 23 to move in the width direction X by a distance enough to recognize the minimum unit of the repetition rule with respect to the reflection pattern RP. Accordingly, it is possible to specify the size of the frame member 32 in a shorter period of time, as compared with a case where the carriage 23 is caused to move across the width-direction X side of the medium supporting portion 30.

Figure 9A:
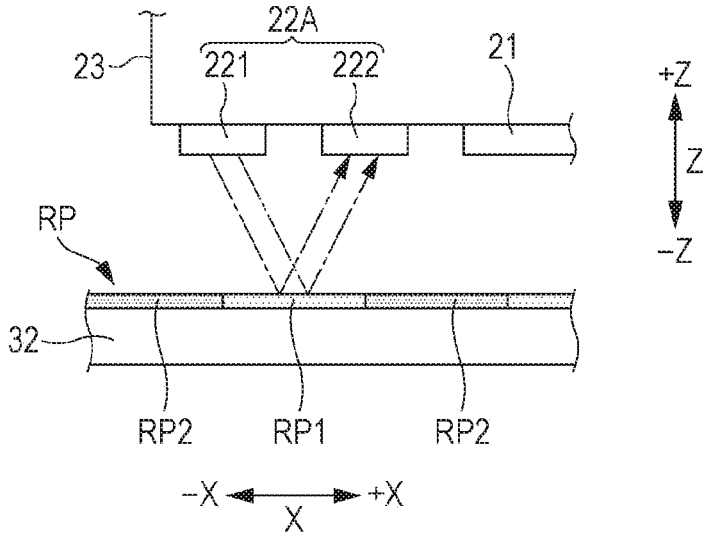
FIG. 9A is a front view illustrating a state in which light that is emitted from a detection portion proceeds in the case where no inclination occurs in a frame member.

As shown in a chain line in FIG. 9A, a detection portion 22A may be a reflection-type optical sensor that emits light having strong directivity toward a detection target. In this case, as shown in FIG. 9A, in the case where the frame member 32 is not inclined, most of reflected light having been reflected at the high reflection portion RP1 of the reflection pattern RP that is formed on the frame member 32 is directed toward the detection portion 22A, and thus, a light amount LV that is able to be detected by the detection portion 22A increases. Further, as shown in FIG. 9A, in the case where, in the width direction X, there occurs no inclination in the frame member 32, the light amount LV of the reflected light from the high reflection portion RP1 becomes substantially constant across in the width direction X, and thus, the light amount difference ΔLV is likely to decrease.

Figure 9B:
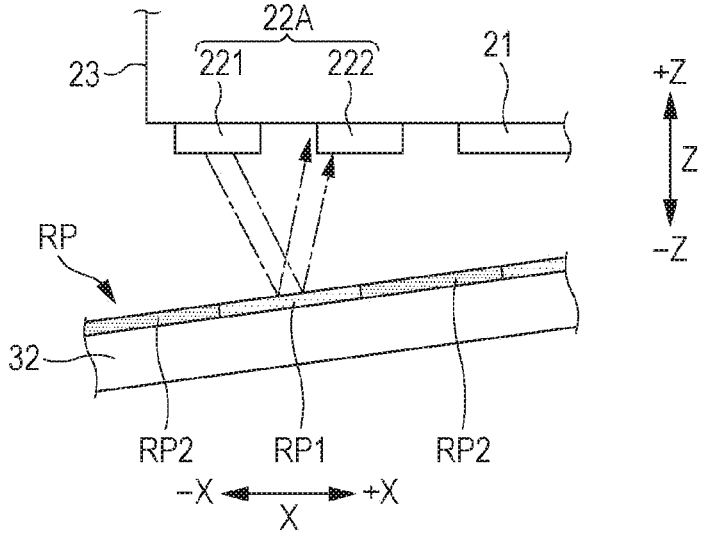
FIG. 9B is a front view illustrating a state in which light that is emitted from a detection portion proceeds in the case where an inclination occurs in a frame member.

In contrast, as shown in FIG. 9B, in the case where the frame member 32 is inclined, part of reflected light having been reflected at the high reflection portion RP1 of the reflection pattern RP that is formed on the frame member 32 is not directed toward the detection portion 22A, and thus, the light amount LV that is able to be detected by the detection portion 22A decreases. For this reason, as shown in FIG. 9B, in the case where, in the width direction X, there occurs an inclination in part of the frame member 32, the light amount LV of the reflected light from the high reflection portion RP1 fluctuates along with the movement of the detection portion 22A in the width direction X, and thus, the light amount difference ΔLV is likely to increase. That is, the light amount LV of the reflected light from the high reflection portion RP1 increases in a portion of the frame member 32, in which no inclination occurs; while the light amount LV of the reflected light from the high reflection portion RP1 decreases in a portion of the frame member 32, in which an inclination occurs, and thus, the light amount difference ΔLV is likely to increase.

As described above, there is a possibility in that a case where the light amount LV of the reflected light from the high reflection portion RP1 decreases in a portion where there arises an inclination in the frame member 32 occurs depending on the state of the attachment of the medium M and/or the type of the detection portion 22 (the light emitting portion 221). Thus, such a situation may be assumed in accordance with the state of the attachment of the medium M and/or the type of the detection portion 22.

In addition, in the modification example described above, just like in the aforementioned embodiment, the execution of the printing operation may be inhibited in the case where the light amount difference ΔLV is large (NO in step S13), and the execution of the printing operation may be allowed in the case where the light amount difference ΔLV is small (YES in step S13).

In the case where the frame member 32 is attached to the mounting table 32, the reflection pattern RP may be formed on the surface of the convex portion 311 of the mounting table 31. Through this configuration, it is possible to determine whether or not the medium M is correctly supported by the medium supporting portion 30 by determining whether or not reflected light rays from the reflection pattern RP that is formed on the concave portion 311, and that is essentially to be covered by the medium M, is received.

The frame member 32 may be coupled to the mounting table 31 via a hinge. In this case, the frame member 32 pivots relatively to the mounting table 31, thereby allowing the frame member 32 to be attached/detached to/from the mounting table 31.

As shown in FIGS. 7A and 7B, according to the aforementioned embodiment, the determination on the presence or absence of the inclination of the frame member 32 in the width direction X is able to be made by determining whether or not the light amount difference ΔLV in the light-amount distribution in the width direction X is larger than or equal to the determination value LVth, but may be made in the following method. That is, during a period from the start until the end of the flowchart shown in FIG. 6, the light amount difference ΔLV may be sequentially calculated simultaneously with sequential updating of a minimum light amount and a maximum light amount. Further, it may be sequentially determined whether or not the frame member 32 is correctly attached to the mounting table 31 by determining whether or not the light amount difference ΔLV is larger than or equal to the determination value LVth. Through this method, it is also possible to determine whether or not the frame member 32 is attached to the mounting table 31 in a state of being inclined in the transport direction Y.

In the flowchart shown in FIG. 6, the processes in steps S12 and S13 may be omitted.

In the flowchart shown in FIG. 6, the processes for the detection operation in steps S16, S17, and S19 may be omitted.

In the aforementioned embodiment, the printing operation is performed in conjunction with the movement of the medium supporting portion 30 in the transport direction +Y, but the printing operation may be performed in conjunction with the movement of the medium supporting portion 30 in the transport direction −Y. In this case, it is preferable that the liquid droplet ejecting portion 21 is located at a more forward position than the position of the detection portion 22 in the transport direction −Y.

In the aforementioned embodiment, in the case where, depending on the detection positions in the width direction X, the light amount difference ΔLV occurs in the light amounts of the reflected light rays from the high reflection portion RP1 of the reflection pattern RP, the determination as to whether or not the frame member 32 is correctly attached to the mounting table 31 is made in accordance with the magnitude of the light amount difference ΔLV, but this configuration may be changed as follows. That is, in the case where, depending on the detection positions in the width direction X, a light amount difference occurs in the light amounts of the reflected light rays from the low reflection portion RP2 of the reflection pattern RP, the determination as to whether or not the frame member 32 is correctly attached to the mounting table 31 may be also made in accordance with the magnitude of the light amount difference.

The printing apparatus 10 may perform unidirectional printing that allows the liquid droplet ejecting portion 21 to eject liquid droplets only in the case where the carriage 23 moves in one of the width direction +X and the width direction −X. Further, the printing apparatus 10 may perform bidirectional printing that allows the liquid droplet ejecting portion 21 to eject liquid droplets in the case where the carriage 23 moves in both of the width direction +X and the width direction −X.

The medium M is not limited to cloth, such as a T-shirt, but may be a medium of a different type. For example, the medium M may be paper, or may be a resin film.

The printing apparatus 10 may be a liquid droplet ejecting apparatus that eject liquid droplets toward the medium M. That is, the liquid ejected by the liquid droplet ejecting portion 21 is not limited to the ink, but may be, for example, a liquid substance in which the particles of a functional material are dispersed or mixed in a liquid. For example, the liquid droplet ejecting apparatus may be configured to perform recording by ejecting a liquid substance that contains a material, such as an electrode material or a coloring material (pixel material) for use in, for example, manufacturing of a liquid crystal display, an electroluminescence (EL) display, or a plane emission display, and that contains the material in the form of dispersion or dissolution.

This application claims priority under 35 U.S.C. §119 to Japanese Patent Application No. 2015-063908, filed Mar. 26, 2015. The entire disclosure of Japanese Patent Application No. 2015-063908 is hereby incorporated herein by reference.

What is claimed is:

1. A liquid droplet ejecting apparatus comprising;

a medium supporting portion that moves in a first direction in a state of supporting a medium;

a liquid droplet ejecting portion that ejects liquid droplets onto an ejection area of the medium supported by the medium supporting portion;

a detection portion that detects a light amount of reflected light of light having been emitted toward the medium supporting portion or the medium supported by the medium supporting portion; and a carriage that reciprocates in a second direction intersecting the first direction, in a state of supporting the liquid droplet ejecting portion and the detection portion, wherein a reflection pattern constituted of a high reflection portion having a high reflectance and a low reflection portion having a low reflectance which are repeatedly arranged in the second direction is formed on the medium supporting portion, wherein the medium supporting portion includes a mounting table on which the medium is mounted, and a frame member that presses the medium onto the mounting table by being attached to the mounting table so as to form a rim surrounding the ejection area, and wherein the reflection pattern is formed on an area of the frame member, the area facing the detection portion.

2. The liquid droplet ejecting apparatus according to claim 1, wherein an arrangement form of the high reflection portion and the low reflection portion in the second direction in the reflection pattern differs in accordance with at least one of the size in the first direction and the size in the second direction of the frame member.

3. The liquid droplet ejecting apparatus according to claim 1 further comprising a determination portion that, when a light amount difference with respect to a light amount of the reflected light from the high reflection portion of the reflection pattern occurs depending on a detection position at which the light amount of the reflected light from the reflection pattern is detected, inhibits the ejection of the liquid droplets by the liquid droplet ejecting portion in a case where the light amount difference is large, and allows the ejection of the liquid droplets by the liquid droplet ejecting portion in a case where the light amount difference is small.

4. The liquid droplet ejecting apparatus according to claim 1 further comprising a control portion that inhibits the ejection of the liquid droplets by the liquid droplet ejecting portion on the basis of a result of the detection of the light amount of the reflected light by the detection portion.

5. The liquid droplet ejecting apparatus according to claim 4, wherein, in the carriage, the liquid droplet ejecting portion is supported at a more forward position than a position of the detection portion in the first direction, and wherein the detection portion detects the light amount of the reflected light during a period of the ejection of the liquid droplets by the liquid droplet ejecting portion.

* * * * *